United States Patent [19]

Rainer et al.

[11] 3,990,190

[45] Nov. 9, 1976

[54] METHOD FOR WORKING OR REWORKING A DIAMOND GUIDE ELEMENT

[75] Inventors: Wolfgang Rainer, Stuhr, Austria; Bodo Schultz; Gerhard Dickopp; Benno Jahnel, all of Berlin, Germany

[73] Assignees: TED Bildplatten Aktiengesellschaft, AEG-Telefunken, TELDEC; AEG-Telefunken-Teldec, both of Zug, Switzerland

[22] Filed: Nov. 25, 1974

[21] Appl. No.: 526,978

[30] Foreign Application Priority Data

Apr. 27, 1974 Germany ..... 2420511

[52] U.S. Cl. ..... 51/283

[51] Int. Cl.[2] ..... B24B 1/00

[58] Field of Search ..... 51/281 R, 281 SF, 283; 123/30; 274/38

[56] References Cited

UNITED STATES PATENTS

| | | | |
|---|---|---|---|
| 3,781,020 | 12/1973 | Batsch et al. | 274/38 |
| 3,848,876 | 11/1974 | Joschko et al. | 274/38 |
| 3,877,705 | 4/1975 | Joschko et al. | 274/38 |

FOREIGN PATENTS OR APPLICATIONS

| | | | |
|---|---|---|---|
| 2,060,317 | 11/1973 | Germany | 274/38 |

*Primary Examiner*—Al Lawrence Smith
*Assistant Examiner*—Nicholas P. Godici
*Attorney, Agent, or Firm*—Spencer & Kaye

[57] ABSTRACT

To prolong the useful life of a diamond guide element which serves to guide a transducer and which is provided with a contact surface via which the element in use bears against the surface of a record carrier while the carrier moves relative to the element, the element is constructed so that the direction of such relative movement corresponds to a high wear resistance direction of the diamond, and the contact surface thereof is periodically ground in an opposite direction in which it has a lower wear-resistance.

10 Claims, 7 Drawing Figures

METHOD FOR WORKING OR REWORKING A DIAMOND GUIDE ELEMENT

BACKGROUND OF THE INVENTION

The present invention relates to working or reworking a diamond guide element by the use of a treating means which is moved relative to the guide element for grinding a profile.

The diamond guide element to which the invention is directed is used to guide a transducer, the guide element having a contact surface which, during the guiding process, bears on the surface of the record carrier while the latter is moved with respect to the guide element in the direction of a relative movement vector.

Starting from a vertex which lies on the contact surface of the guide element, there can be defined a directional vector which extends parallel to one of the wear-resistant directions of the diamond and substantially parallel to the plane of the direction of the contact force and of the relative movement vector. An acute angle $\beta \geqslant 0°$ is formed between the longitudinal direction of the diamond contact surface, which has the ground-in profile, and the surface of the record carrier. A further acute angle $\delta \geqslant 0°$ is formed between the above-mentioned directional vector, beginning at the vertex, and the longitudinal direction of the profiled contact surface, and an angle $\gamma \geqslant 0$ is formed between the directional vector starting at the vertex, and the surface of the record carrier.

It has been found that during pressure scanning of very densely stored signals, and in view of corresponding small size of the diamond, the profile-ground contact surface wears rather rapidly.

It is known that wear of the contact surface can be counteracted by aligning the diamond guide element so that during scanning one of the most wear-resistant crystallographic directions of the diamond lies approximately in the direction of the relative movement of the record carrier with respect to the guide element or in the direction of the running edge. Wear-resistant directions in this connection are disclosed in German Pat. No. 2,060,317 issued Nov. 29, 1973, and in corresponding U.S. Pat. No. 3,781,020.

Although the longitudinal direction of the running edge of the relative movement direction of the guide element had been aligned with one of the most wear-resistant crystallographic directions, it was found that the quality of the scanned signals noticeably deteriorated after a short time during pressure scanning.

The reason for premature reduction in the scanning quality is not wear of the contact surface, but the deteriorating effectiveness of the sharp trailing edge which during pressure scanning is located between the contact surface and a limiting surface on the diamond. This edge may become round or, which is even worse, it may remain sharp but be subject to less pressure because of the more spherical shape of the contact surface, or may finally completely lose contact with the record carrier surface.

The guide element is provided with a ground-in profile which lies in a plane approximately perpendicular to the scanning direction when the guide element is used for pressure scanning the associated groove on the record carrier. In order for this precisely ground profile, and thus the scanning quality, to remain unchanged, the diamond is worked or reworked at its contact surface, as disclosed in German Offenlegungsschrift (Laid Open Application) No. 2,053,866 laid open on June 8, 1972.

This can be effected only during the time between two playback operations, i.e., in the intervals between scanning. It has here been found that working or reworking according to the known methods is very time consuming.

It is known to grind a diamond transversely to the most wear-resistant crystallographic direction. However, on a guide element with a ground profile such transverse grinding is impossible.

SUMMARY OF THE INVENTION

It is an object of the present invention to reduce the working or reworking time for a guide element of a pickup, which in pressure scanning may simultaneously be the scanning element and which scans signals stored on a record carrier.

These and other objects according to the invention are achieved by a novel method and apparatus for conditioning a surface of a diamond guide element which is employed to guide a transducer and presents a contact surface by which the element bears against the surface of a record carrier as the carrier moves relative to the guide element in a direction defined by a relative movement vector, one end of the contact surface being defined by a vertex, there being a directional vector which originates at the vertex and which extends parallel to one of the wear-resistant directions of the diamond and substantially parallel to a plane defined by the relative movement vector and the direction in which the element bears against the record carrier, in such plane the surface of the element forming a first acute angle, greater than or equal to zero, with the carrier surface and a second acute angle, greater than or equal to zero, with the directional vector, and the directional vector forming a third acute angle, greater than or equal to zero, with the carrier surface. According to the invention the guide element is so formed that the relative movement vector, defining the direction in which the element is subjected to frictional forces by the moving carrier, extends in a direction in which the element has a high wear-resistance, and the surface of the element is periodically ground in a direction which differs from the direction of the relative movement vector and in which the element has a lower wear-resistance.

The advantages offered by the present invention are mainly that such alignment of the wear-resistant direction of the diamond relative to the record carrier surface and selection of the various specified angles produces little wear on the diamond during playback, while during working or reworking with the treating means a large amount of material is removed from the diamond per unit time, i.e., a high removal rate is achieved. Thus the treatment time between two playback operations can be kept short.

The wear-resistant direction is preferably the [110] direction or an equivalent direction within a crystallographic cubic surface because this direction results in the highest wear resistance and because in this case a natural octahedron peak can be very easily ground into a guide element or scanning element.

DESCRIPTION OF THE PREFERRED EMBODIMENTS

Figure 1:
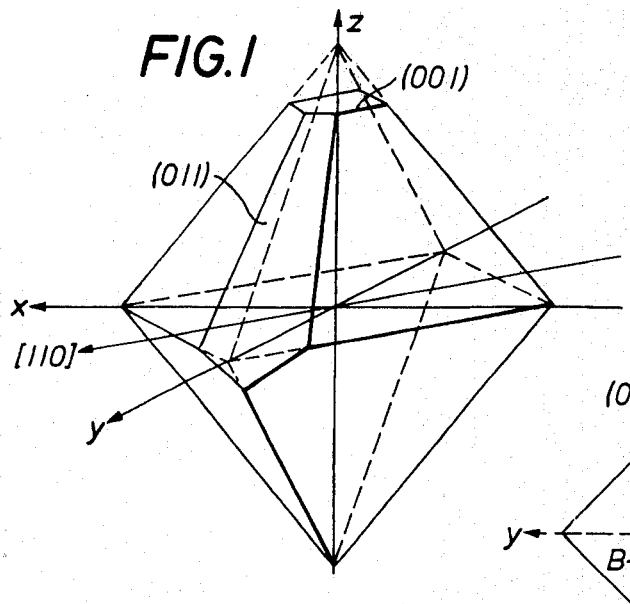
FIG. 1 shows a diamond octahedron in a regular system including the wear-resistant direction [110], a cubic surface (001) and a dodecahedron surface (011).

FIG. 1 shows in cartesian coordinates X, Y, Z a diamond octahedron in which one of the crystallographic directions in which the diamond is particularly wear-resistant is identified by the Miller Index [110]. This direction lies in the X–Y plane or in any plane parallel thereto; these planes are crystallographic cubic surfaces, e.g., (001). The drawing figure also shows a dodecahedron surface (011) at the diamond octahedron, which surface forms an angle of 45° with the cubic surface (001).

The experimentally obtained values in the diagrams of FIGS. 4 and 5 will now be explained with reference to the views of FIGS. 2 and 3.

First the wear-resistant direction of a cubic surface will be described. In FIG. 2 the direction of movement of the treating means, when these means are in the position of the member 11 in FIG. 7, extends at a positive angle $\delta$ into the first quadrant. Positive angles $\delta$ between the inverse [$\bar{1}\bar{1}$0] to the wear-resistant direction [110] and the treatment direction B in FIG. 4 indicate the range in which rapid removal in $\mu^3$/minute, can be obtained at the diamond during treatment. In this case the diamond is being treated from the bottom, i.e., with the contact pressure force produced by the treating means 11 of FIG. 7 extending in the z direction. The most favorable removal rate is thus attained at a positive angle $\delta$ of 12°, while all negative values of $\delta$ result in comparatively low removal rates.

Figure 2:
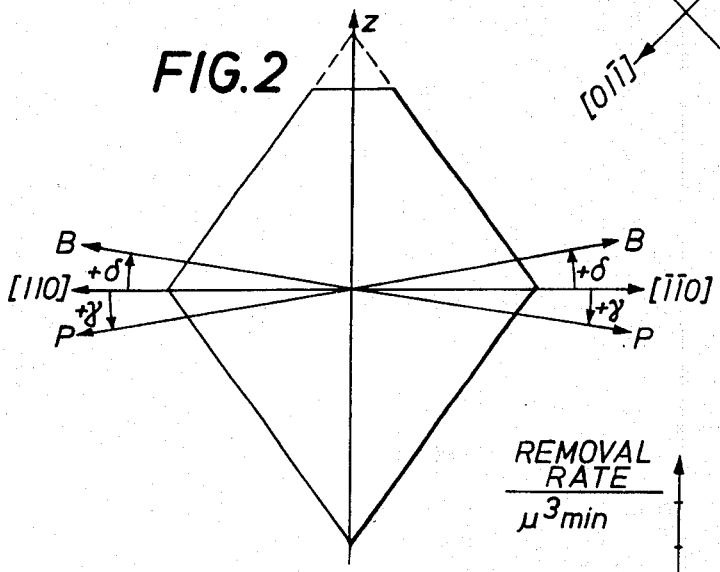
FIG. 2 is a sectional view of the element of FIG. 1, in the plane defined by the wear-resistant direction [110] and the Z-axis.

If in FIG. 2 the direction of movement B of the treating means 11 is shifted into the second quadrant, however, the angle $\delta$ will also be positive for reasons of symmetry, [$\bar{1}\bar{1}$0] being a wear-resistant direction just as [110]. If the angle $\delta$ becomes negative, i.e., if the direction of movement of the treating means points into the third or fourth quadrant, substantially reduced removal rates result, as shown in FIG. 4.

Positive angles $\gamma$ and $\gamma \approx 0$ indicate the range in a diamond into which the direction of stress P an be placed in order to obtain little removal during playback. According to FIG. 2, positive $\gamma$ points into the third or fourth quadrant. For reasons of symmetry the angle $\gamma$ is positive in both cases and in the diagram of FIG. 4 a low removal rate can be seen. The most favorable removal rate during operation here lies at the diamond at an angle of $\gamma \approx 0°$, and the wear-resistant direction [110] is then parallel to the surface 2 of the record carrier 3 of FIG. 6.

Figure 4:
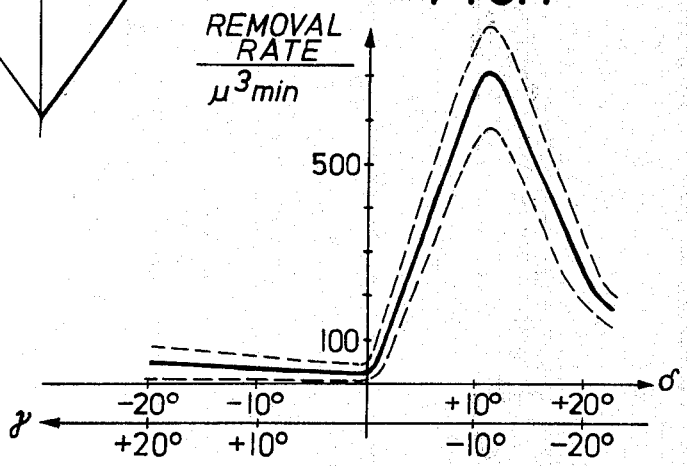
FIG. 4 is a diagram relating to a wear-resistant direction [110] of the cubic surface (001), showing the values of the removal rate as a function of the angle $\delta$ which is formed, during working of the contact surface, between this contact surface and a parallel to one wear-resistant direction, as well as the removal rate during playback in dependence on the angle $\gamma$ formed between the wear-resistant direction and the surface of the record carrier.

If the direction P of the relative speed of the record carrier, which approaches the diamond of FIG. 2 from the bottom, points into the first or second quadrant of FIG. 2, angle $\gamma$ becomes negative and in the diagram of FIG. 4 a high removal rate during playback can be predicted for the diamond.

Relationships similar to the above-described angles $\delta$ and $\gamma$ and the wear-resistant directions [110] and [$\bar{1}\bar{1}$0] in a cubic surface of the diamond according to FIG. 2 and as for the diagram of FIG. 4, exist for the angles $\delta'$ and $\gamma'$ and the wear-resistant directions [01$\bar{1}$] and [0$\bar{1}$1] in a dodecahedron surface of the diamond. The diagram of FIG. 5 shows the most favorable values for the angles $\delta'$ and $\gamma'$ for the direction of stress P and the working direction B in a dodecahedron surface. The highest removal at the diamond is attained at an angle $\delta'$ of about +35° and the least removal rate during playback lies at an angle $\gamma'$ of $\approx$ 30°.

The values set forth in the diagrams also give a clear picture of how close or tight the manufacturing tolerances must be for a diamond.

Figure 6:
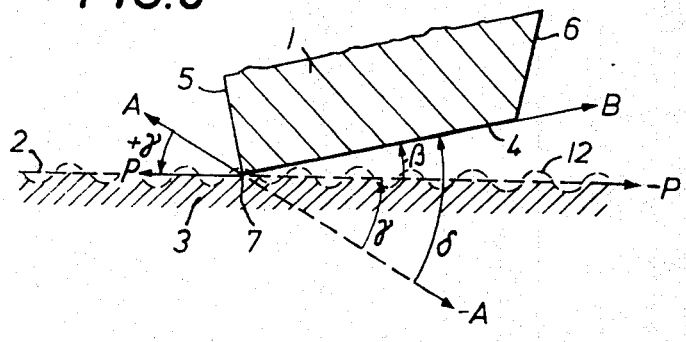
FIG. 6 is a longitudinal sectional view of the guide element or scanning element aligned according to the invention during playback operation as well as during working or reworking.

The guide element, or the scanning element 1 of FIG. 6 when it contacts a record carrier 3 which is moved relative to the guide element, is stressed by frictional forces in a direction, i.e., the direction of the relative movement vector P in which it has a high wear-resistance.

However, during profile grinding, the guide element is stressed in a different direction, i.e., the direction of the treating vector B, which is the direction of the relative movement of the treating means, and in this direction the wear-resistance is less. The two directions B and P, which can be considered to lie in a plane which is perpendicular to the surface 2 of the record carrier 3, form between themselves an angle which is other than 180°. The guide element 1 has two surfaces 5 and 6 which bound its contact surface 4. The macroscopic surface 2 of the record carrier, is that surface which exists apart from the groove hills and dales 12. The groove dales and hills contain the stored information. The contact surface 4 is always disposed at a certain angle $\beta$ to the surface 2 of the record carrier 3. The orientation of surface 5 in the illustrated case, which is particularly applicable for pressure scanning, is asymmetrical to the orientation of the contact surface 4, with respect to surface 2. The orientation of surface 5 with respect to the contact surface 4, which both intersect at an edge or corner 7, prevents contact of the surface 5 with a groove hill 12 on the record carrier so that perfect pressure scanning is assured by the edge or corner 7 of the diamond, as disclosed in German Pat. No. 1,574,489, issued Jan. 27, 1972, and in corresponding U.S. Pat. No. 3,652,809.

The diamond guide element 1 of FIG. 6 which also serves as the scanning element, is aligned to its wear-resistant crystallographic direction A. This wear-resistant direction A must lie substantially within the lowest index plane of the diamond. The lowest index planes are the cubic, dodecahedron and octahedron surfaces. In a cubic surface the direction [110] or [$\bar{1}\bar{1}0$] or [110] or [$\bar{1}10$] is applicable as direction A, in a dodecahedron surface the direction [01$\bar{1}$] or [0$\bar{1}$1] or an equivalent direction.

If a wear-resistant direction of a dodecahedron surface is used for the scanning element, the treating direction and the wear-resistant direction will lie approximately in a Y, Z plane of the diamond. This plane is perpendicular to a cubic surface (001) as well as to a dodecahedron surface (011) which forms an angle of 45° with the cubic surface. The direction of the treating vector B will then for example be selected to extend from the cubic surface (001) to the dodecahedron surface (011) (see the vector B pointing to the left hand in FIG. 3) in an angular range of from about 0° to a maximum of 30° with respect to the cubic surface. Since in the illustration of FIG. 3 the treating means is always brought toward the diamond from the top left, this angular range corresponds to a range for $\delta'$ from 45° to 15°. However, the relative movement vector P is selected to extend for example from the dedecahedron surface (011) to the cubic surface (001) (see the vector P pointing to the right hand in FIG. 3) in an angular range of > 10° to 45° with respect to the cubic surface (corresponding to $+35° > \gamma' \geqslant 0°$).

Nevertheless every other combination of the vectors B and P may be selected if only the cited angular ranges will be observed. In some cases it will be necessary to cut off a piece of the diamond in order to be sure that at least one edge or corner of the treated contact surface can contact the carrier surface.

Figure 3:
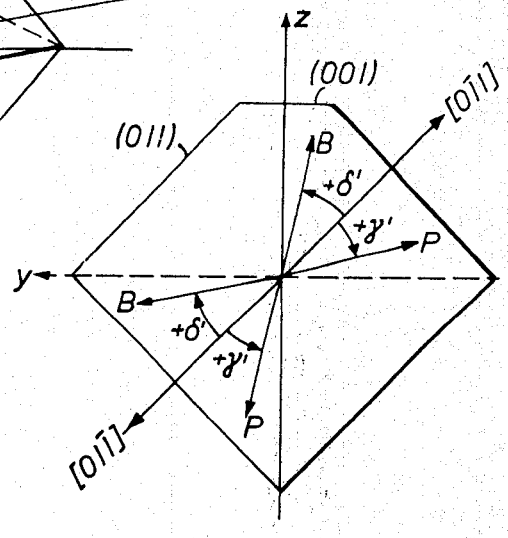
FIG. 3 is a second sectional view of the element of FIG. 1, in the plane defined by the wear-resistant direction [01$\bar{1}$] in a dodecahedron surface and the Z-axis.

By the way it is possible (because of the symmetrical properties of the diamond) to turn the diamond in the plane of FIG. 3 about 90°, 180° or 270°, without any principal change in the described relations, if the vectors B, P and the angles $\delta'$ and $\gamma'$ preserve their positions and if the treating means and the carrier are further on brought toward the diamond from the top left.

In order to assure perfect guidance or pickup quality respectively, during scanning over long periods of time, and in order to increase the life time of the profile-ground diamond, the contact surface of the diamond must be treated before the first playback operation and between two playback operations, i.e., by profile grinding with a treating means which moves in the longitudinal direction of the contact surface 4, which lies in the plane of the drawing of FIG. 6.

In order to produce as high a removal rate as possible, the diamond guide element is aligned in the following special manner.

The angle $+\gamma$ between direction P on the surface 2 of the record carrier 3 and the wear-resistant direction A is assumed in FIG. 6 to be 30°. This angle simultaneously indicates the range in which one of the wear-resistant directions should preferably lie if the alignment is effected as shown in FIGS. 2 and 4, i.e., if A is a wear-resistant direction in a cubic surface. The removal rate in $\mu^3$/minute at the diamond during playback operation for various positive angles $\gamma$ between the wear-resistant direction A and surface 2 is substantially less than the removal rate for the treatment effected at the positive angle $\delta$, as demonstrated by the diagram of FIG. 4, if the following conditions are met:

a. the directional vector A is selected to be parallel to one of the four most wear-resistant directions ([110]), ([$\bar{1}\bar{1}$0]) within a crystallographic cubic surface;

b. the vector B defining the direction of movement of the treating means extends from the vertex into an area which is bounded by a plane and in which the reaction force on the guide element points when the latter contacts the record carrier 3, this plane passing through the vertex, and being parallel to the vector A, and forming an angle $\gamma$ with the surface 2 of record carrier 3;

c. the guide element is aligned so that $\gamma \neq 90°$;

d. vector A, −A is placed outside of an angular range $\beta$ or at most in the immediate vicinity of an edge of that angular range $\beta$ which always encompasses less than 180° and which extends between the treating vector B and the negative, −P, of the relative scanning movement vector, which also begins at vertex 7, such edge being the edge at vector −P; and e. the ratio between angles $\gamma$ and $\delta$ is selected so that the removal rate, under the same conditions, is greater in the direction of the treating vector B than in the direction of the vector P defining the movement of carrier 3 relative to body 1 during signal scanning.

Below the skid-shaped guide element 1 the record carrier 3 slides in the direction P. This direction P of the moving record carrier 3 is the preferred direction as determined by experiments, particularly if $\gamma \approx 0$, or only slightly more, and if A lies in a cubic surface. An oppositely directed movement of record carrier 3 would also be possible; however, then the treatment direction would have to be associated differently with respect to the wear-resistant direction.

It must also be mentioned that it is known, for $\gamma \approx 0$, to work the diamond by profile grinding approximately in its wear-resistant direction A in the direction opposite to vector B, representing the direction of movement of the treating means relative to element 1. However the time required for treatment in such a case is too long. Transverse grinding, which could reduce the treatment time, is impossible for a diamond having a profiled surface. According to the present invention, the contact surface 4 of the diamond is therefore ground in such a way that a high removal rate is obtained during treatment so that the treatment time can be kept as short as possible.

In the embodiment of FIG. 6, particularly if $\gamma$ is small, the direction of treatment, B, is approximately opposite to the wear-resistant direction A and to the relative movement vector P of the record carrier 3. For a profile-ground, asymmetrical guide element 1 as shown in FIG. 6 in a longitudinal section along the direction of the profile grinding, the contact surface 4 is limited in direction P by a surface 5. The vector −A, which is directed opposite to the wear-resistant direction and which is shown by a broken line, lies in a cubic or in a dodecahedron surface, and is again a wear-resistant direction, and is identified for a cubic surface, as the directional vector. The acute angle $\delta$ is disposed between the directional vector (broken line) formed by the opposite, or inverse, to the wear-resistant direction A which starts at the corner or edge 7 and the vector of the direction of the movement B of the treating means, which also starts at the corner or edge 7, i.e., the profile grinding direction B. The angle $\delta$ preferably has a value up to 20°, particularly 12°, as shown in FIG. 4. The vector of the wear-resistant direction A and the directional vector −A, each starting from the edge or corner 7 which forms the vertex for all illustrated angles, are assumed to lie outside the guide element in the embodiment of FIG. 6, the direction A having a component in direction P and also in the direction of the contact pressure of the treating means, because then the guide element exhibits a self-sharpening action, as the contact surface 4 and even the surface 5 tend to a greater wear then the edge or corner 7 which is primary stressed in the direction of the vector A.

Figure 5:
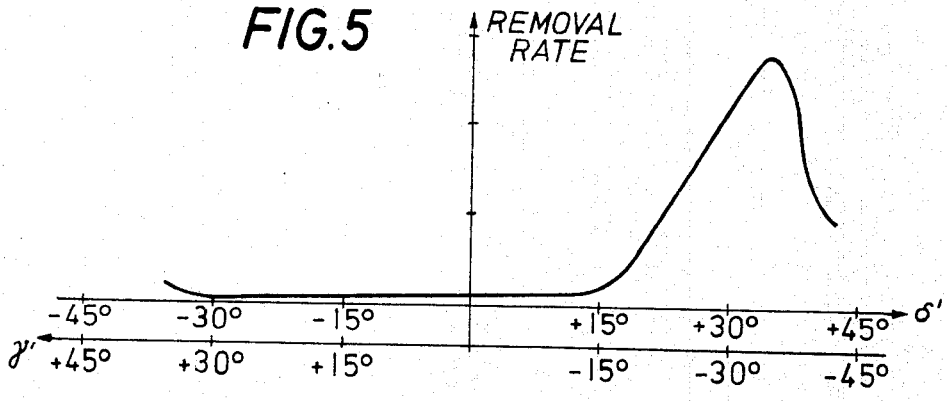
FIG. 5 also is a diagram similar to that of FIG. 4, but relating to the wear-resistant direction [01$\bar{1}$] of a dodecahedron surface used as the zero point on the abscissa.
Figure 7:
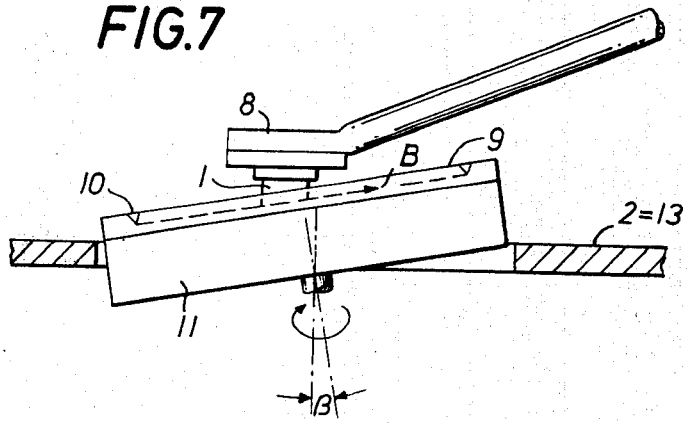
FIG. 7 is a simplified elevation view of an embodiment of a reworking or working device for a pressure scanning device.

As shown in the diagrams of FIGS. 4 and 5, a close relationship exists between angle $\gamma$ or $\gamma'$, respectively, whose positive values indicate the preferred range for the relative movement vector P, and angle $\delta$ or $\delta'$, respectively, which is limited by the contact surface 4 and the inverse (−A) to the wear-resistant direction A, preferably $[\bar{1}\bar{1}0]$ or $[0\bar{1}1]$, respectively, or equivalent directions and which, in the embodiment of FIG. 6, also includes the treatment angle $\beta$. When the alignment is made with a wear-resistant direction of the cubic surface, the ideal case in this embodiment with the most favorable removal rates during treatment would be given, according to FIG. 4, if the wear-resistant direction A were to coincide with the direction of vector P. Then treatment could be effected at an angle $\delta = 12°$ to achieve the greatest removal rate. The treating angle $\beta$ is the angle which is formed, as depicted in FIG. 7, between the treating surface 9 and the surface 2 of the record carrier 3, the surface 2 in FIG. 7 coinciding with the chassis surface 13. In this ideal case, the angle $\beta$ would coincide with the angle $\delta$ formed between −A, the opposite to the wear-resistant direction, and the contact surface 4, and thus angle $\gamma$ would be zero.

Other favorable angle combinations between angles $\gamma$ or $\gamma'$, respectively, $\delta$ or $\delta'$, respectively, and $\beta$ can be found in the diagrams of FIGS. 4 and 5, care being taken, however, that the arm of angle $\gamma$ formed by the surface 2 must always lie outside the guide element.

In the embodiment shown in FIG. 7, the treating means 11 for a guide element or a scanning element 1 for pressure scanning is pivoted through the angle $\beta$ formed between the contact surface 4 and the surface 2 of the record carrier 3. It is also conceivable to pivot the guide element 1 through the angle $\beta$ while the surface of treating means 11 continues to lie in surface 2. An annular groove is disposed in surface 9 of the treating means 11 and the guide element or scanning element 1 can be worked or reworked by engaging in that groove.

In the preferred utilization of a wear-resistant direction in a cubic surface as the above-mentioned direction A, it is particularly surprising that selection of the treating direction so that it extends almost in the opposite direction from the direction of relative velocity of the record carrier makes it possible for the treatment to be effected substantially faster than with a direction of treatment approximately in the direction of such relative velocity; because one would really suspect that the same treatment speeds would result regardless of whether or not the treatment direction is reversed, since, due to the crystallograhic equivalent of these directions, the same wear-resistances result in the [110] direction as well as in the opposite $[\bar{1}\bar{1}0]$ direction.

It will be understood that the above description of the present invention is susceptible to various modifications, changes and adaptations, and the same are intended to be comprehended within the meaning and range of equivalents of the appended claims.

We claim:

1. In a method for conditioning a surface of a diamond guide element which is employed to guide a transducer and presents a contact surface by which the element bears against the surface of a record carrier as the carrier moves relative to the guide element in a direction defined by a relative movement vector, one end of the contact surface being defined by a vertex, there being a directional vector which originates at the vertex and which extends parallel to one of the wear-resistant directions of the diamond and substantially parallel to a plane defined by the relative movement vector and the direction in which the element bears against the record carrier, in such plane the surface of the element forming a first acute angle $\beta$, greater than or equal to zero, with the carrier surface and a second acute angle $\delta$, greater than or equal to zero, with the directional vector, and the directional vector forming a third acute angle $\gamma$, greater than or equal to zero, with the carrier surface, the improvement wherein:

said guide element is so formed that the relative movement vector, defining the direction in which said element is subjected to frictional forces by the moving carrier, extends in a direction in which said element has a high wear-resistance;

and said conditioning method comprises grinding the surface of said element in a grinding direction which differs from the direction of the relative movement vector and in which the element has a lower wear-resistance.

2. A method as defined in claim 1 wherein said relative movement vector forms an angle unequal to 180° with said grinding direction.

3. A method as defined in claim 2 wherein said diamond possesses a cubic surface (001) and a dodecahedron surface (011) forming a 45° angle with said cubic surface, said diamond is formed so that said relative movement vector and said grinding direction form a plane perpendicular to such cubic surface and such dodecahedron surface, said grinding direction extends from said cubic surface to said dodecahedren surface at an angle of between 0° and 30° to such cubic surface and said relative movement vector extends from said dodecahedron surface to said cubic surface at an angle of between 10° and 45° to such cubic surface.

4. A method as defined in claim 1, wherein:

a. said directional vector is oriented parallel to one of the four most wear-resistant directions [110], $[\bar{1}\bar{1}0]$, [110], $[1\bar{1}0]$ within a crystallographic cubic surface of said diamond;

b. said grinding direction extends from said vertex at one end of the guide element contact surface into an area which is bounded by a plane containing the directional vector and forming said third angle with the carrier surface, said area being the one in which the reaction force on the guide element points when it contacts the carrier;

c. said guide element is formed and oriented so that said third angle has a value unequal to 90°;

d. said directional vector extending in a region nearly totally outside of another region enclosed by said first acute angle, but yet including the immediate vicinity of one side of said other region which side is defined by the carrier surface; and e. the ratio between the third and second angles, $\gamma$ and $\delta$ respectively is selected so that the removal rate, under the same conditions, is greater in said guiding direction than in the direction of said relative movement vector.

5. A method as defined in claim 4 wherein said step of grinding forms a sharp edge or a corner at the vertex between said contact surface and one of the end surfaces of said element bordering said contact surface.

6. A method as defined in claim 5 wherein said one of the end surfaces of said element delimits said contact surface in the direction of said relative movement vector, said one of the end surfaces being inclined more steeply to the surface of the record carrier than is said contact surface, and said grinding direction has a predominant component which extends opposite to the direction of said relative movement vector.

7. A method as defined in claim 6 wherein said second angle $\delta \leq 20°$.

8. A method as defined in claim 7 wherein said second angle $\delta \approx 12°$.

9. A method as defined in claim 4 wherein said third angle $\gamma > 0°$ to approximately $10°$.

10. A method as defined in claim 9 wherein the said third angle $\gamma \approx 0°$.

* * * * *

UNITED STATES PATENT AND TRADEMARK OFFICE

CERTIFICATE OF CORRECTION

PATENT NO. : 3,990,190

DATED : November 9th, 1976

INVENTOR(S) : Wolfgang Rainer et al

It is certified that error appears in the above-identified patent and that said Letters Patent are hereby corrected as shown below:

In the heading of the patent, change item [73] to read:
--[73] Assignee: TED Bildplatten Aktiengesellschaft
AEG-Telefunken-Teldec, of Zug, Switzerland--

Column 4, line 2, change "an" to --can--.

Column 5, line 23, change "dedecahedron" to --dodecahedron--.

Column 7, line 5, change "then" to --than--.

Column 8, line 65, change "guiding" to --grinding--.

Signed and Sealed this

First Day of February 1977

[SEAL]

*Attest:*

RUTH C. MASON
*Attesting Officer*

C. MARSHALL DANN
*Commissioner of Patents and Trademarks*